US005966904A

United States Patent [19]

Peters

[11] Patent Number: 5,966,904

[45] Date of Patent: Oct. 19, 1999

[54] DEVICE AND METHOD FOR PACKAGING A MATERIAL WEB ROLL

[75] Inventor: Hans-Josef Peters, Kleve, Germany

[73] Assignee: Voith Sulzer Finishing GmbH, Krefeld, Germany

[21] Appl. No.: 08/991,646

[22] Filed: Dec. 16, 1997

[30] Foreign Application Priority Data

Dec. 17, 1996 [DE] Germany ..... 196 52 451

[51] Int. Cl.[6] ..... B65B 11/04

[52] U.S. Cl. ..... 53/399; 53/64; 53/465; 53/587; 53/211

[58] Field of Search ..... 53/465, 399, 587, 53/211, 214, 215, 372.9, 415, 64

[56] References Cited

U.S. PATENT DOCUMENTS

| | | | |
|---|---|---|---|
| 3,828,523 | 8/1974 | Brenner et al. . | |
| 3,924,375 | 12/1975 | Brenner et al. | 53/372.9 X |
| 4,173,108 | 11/1979 | Eglinton et al. . | |
| 4,524,562 | 6/1985 | Yagi et al. | 53/372.9 X |
| 5,265,399 | 11/1993 | Niskanen et al. | 53/214 X |

FOREIGN PATENT DOCUMENTS

| | | |
|---|---|---|
| 1009556 | 5/1957 | Germany . |
| 1138682 | 10/1962 | Germany . |
| 19535746 | 4/1997 | Germany . |
| 1429445 | 3/1976 | United Kingdom . |

*Primary Examiner*—Linda Johnson
*Attorney, Agent, or Firm*—Greenblum & Bernstein, P.L.C.

[57] ABSTRACT

Device and method for packaging a material web roll, having a longitudinal axis, with a packaging sheet. The device may include a carrier positioned to carry the material web roll, a packaging sheet dispenser positioned to be movable parallel to the longitudinal axis and to dispense the packaging sheet onto at least a portion of a longitudinal extend of the material web roll to form an acute angle between a dispensing direction of the packaging sheet and the longitudinal axis, and a positioning sensor positionable to determine an axial position of the material web roll on the carrier. The method may include substantially continuously determining an axial position of the material web roll during the helical wrapping and controlling an axial advance of a packaging sheet dispenser in accordance with a momentary determined axial position of the material web roll.

35 Claims, 3 Drawing Sheets

DEVICE AND METHOD FOR PACKAGING A MATERIAL WEB ROLL

CROSS-REFERENCE TO RELATED APPLICATION

The present application claims priority under 35 U.S.C. § 119 of German Patent Application No. 196 52 451.2 filed Dec. 17, 1996, the disclosure of which is expressly incorporated by reference herein in its entirety.

BACKGROUND OF THE INVENTION

1. Field of the Invention

The present invention relates to a device for packaging a material web roll with a packaging sheet. The device includes a packaging sheet dispenser that is movable parallel to an axial direction of the material web roll and that dispenses a packaging sheet to at least one part of the axial length of the material web roll at an angle to the axial direction of the sheet or web roll. The angle being acute with respect to a lateral direction of the material web roll. The device also includes carrier rolls positioned such that the material web roll rests on the carrier rolls.

The present invention also relates to a method for wrapping a material web roll with a packaging sheet such that the packaging sheet is wrapped around the material web roll along a helical line.

2. Discussion of Background Information

A device and a method similar in general to that discussed above are known from, e.g., GB 1 429 445, in which a plastic sheet is wrapped in a helical line around a material web roll. At the axial ends of the material web roll, an angle between the packaging sheet dispenser and the material web roll is aligned to 90° and the sheet is further wound around the material web roll to create end packaging. Once provided with circumferential packaging, the material web roll is guided through a heating furnace to shrink-wrap the plastic sheet onto the material web roll.

Packaging a material web roll within a packaging sheet guided along a helical line around a longitudinal axis of the material web roll has the advantage that a plurality of material web rolls having varying widths can be wrapped with a single width of packaging sheet. Thus, this arrangement simplifies the supply and the handling because the packaging sheet can be narrower than the material web roll. Further, its weight is correspondingly lighter.

However, using plastic wrap as the packaging sheet may present certain disadvantages with respect to environmental problems. However, the use of packing paper as the packaging sheet causes other problems. The body packaging wrapped around the material web roll along the helical line must be separated from each end packaging on the axial ends of the material web roll by cutting through the packaging sheet running in the circumferential direction. Then the packaging sheet must be realigned to the material web roll and fastened thereto, e.g., as discussed in DE 195 35 746 A1.

It has been observed that the material web roll also has a tendency for axial migration during production of the body packaging. That is, during the helical wrapping of the material web roll with the packaging sheet, the material web roll may migrate or move, e.g., one or more centimeters, in its axial direction. This migration may be caused by the fact that, during production of the body packaging, the material web roll exhibits a larger diameter on one end of the roll than on the other. With each rotation, the roll thus migrates slightly in a direction of the larger diameter. Because several rotations of the material web roll occur during the packaging procedure, a correspondingly great migration results. Thus, when the packaging sheet dispenser is placed in a new position, under certain circumstances, the end packaging may not be attached at the desired location, but, rather, unintentionally axially displaced along the length of the material web roll.

SUMMARY OF THE INVENTION

The present invention provides a packaging device and method that improves the quality of the packaging. The above-mentioned device includes a positioning sensor for determining an axial position of the material web roll on the counter.

By utilizing the positioning sensor, information may be gathered which is very helpful in performing a number of steps in the packaging process. For example, the axial position of the material web roll situated on the carrier rolls can be determined even prior to wrapping. Thus, it is not necessary to place the material web roll in the exact center (i.e., axially) of the carrier rolls, which is the case in the prior art packaging devices. Thus, in accordance with the features of the present invention, the material web roll needs only to be placed in a work area that is accessible to all of the essential packaging components or aggregates, e.g., a packaging sheet dispenser or packing presses, folding devices, face cover feeding devices, etc. While the feeding device almost always places the material web roll in the work area, the additional positioning step is eliminated in the present invention. Accordingly, the entire packaging process can be somewhat shortened. During production of the end packaging, the axial position of the material web roll can be determined so that the end packaging can be positioned on the material web roll with greater accuracy. Since the packaging sheet dispenser is axially movable, no additional measurements are required if the information about the axial position of the material web roll is available.

The positioning sensor is preferably a distance sensor which monitors or cooperates with a face of the material web roll. Further, a single sensor can determine a plurality of positions, and may determine the positions relative to a known reference point. In this manner, the position of the material web roll may be relatively easy to determine.

In a preferred embodiment of the present invention, the positioning sensor may be formed as an ultrasound-distance meter. Sensors of this type generally function reliably and with sufficient accuracy for the purposes of the present invention. Further, these devices may be small and relatively inexpensive to obtain.

In accordance with the features of the present invention, it is advantageous that the positioning sensor is axially movable with respect to the material web roll. In this manner, a location detector may also be provided to determine the axial position of the positioning sensor, e.g., with respect to a reference point. Because the material web rolls being packaged by the device and method of the present invention may generally have axial lengths of, e.g., approximately 0.5 to 3.8 meters, and even greater, the necessary measuring range for a distance meter widely varies. As the measuring range of the distance meter increases, the meter becomes costlier and/or has a greater failure tolerance. Thus, the present invention locates the positioning sensor for movement in the axial direction so that a certain, substantially consistent measurement range could be established. The positioning sensor may be moved until the distance to the face of the material web roll is within the desired measurement range. Then a distance from the position sensor to the face of the material web roll may be made with a relatively high degree of accuracy. Further, the location detector may be utilized to determine the distance between the point of reference the position of the positioning sensor. In this manner, the precise position of the face of the material web roll can be calculated by adding the distance from the point of reference to the positioning sensor and from the positioning sensor to the face of the material web roll. The reference point may be located, e.g., in the frame of the device so that all other components or aggregates of the device could refer to the same.

In accordance with another advantage of the present invention, the device may include a folding device located on a movable carrier that wraps an axial projection of the packaging sheet onto the face of the material web roll. Further, the positioning sensor may be coupled with the movable carrier. In this manner, the positioning sensor can be moved in front of the face of the material web roll in tandem with the folding device. Moving the folding device in such a manner is necessary if the axial projection of the packaging sheet is to be wrapped on the face of the material web roll. However, the folding device must be suitable for varying diameters of the material web rolls requiring packaging, which could range from, e.g., approximately 0.5 to 2.5 m. By coupling the positioning sensor with the carrier of the folding device, one work increment may be saved. That is, in the course of packaging, the folding device must be pivoted around to the face anyway. However, the repositioning of the folding device may be performed at an earlier point so as to reduce the length of time of the packaging procedure. It may be further advantageous if the positioning sensor also determines the position of the end packaging. In this manner, the folding device can be positioned at a correct location on the material web roll to enable wrapping of the end packaging projection on the face with the desired measurements.

The folding device may preferably include a rotatable folding wheel, and the positioning sensor may be arranged on an assisting carrier which protrudes radially over the folding wheel. In this arrangement, the positioning sensor cannot be covered up by the folding wheel, and it may, preferably, project radially inward toward the center of the face of the material web roll when the folding device is pivoted or pulled forward. In this manner, the sensor may contact the face regardless of the diameter of the material web roll. Such an assisting carrier may be provided as a feeling arm to secure the inner face cover during the wrapping of the projection on the face.

It may be particularly advantageous if the positioning sensor continuously determines the axial position of the material web roll, at least during one rotation of the material web roll. As mentioned above, migration of the material web roll that occurs during the helical wrapping of the material web roll with a packaging sheet cannot be overlooked. However, if the position of the material web roll is constantly monitored via the positioning sensor, corrective or adjusted action can be taken more quickly when errors occur, thus, substantially avoiding serious damages.

This ability to effect corrective or adjusted action may be particularly provided by coupling the positioning sensor with a control device that controls the axial positioning of the packaging sheet. The packaging sheet dispenser may be moved parallel to the axis of the material web roll at a velocity calculated from a slope of the helical line and a circumferential velocity, or the number of rotations of the material web roll. Further, if axial movement of the material web roll, i.e., migration, which could amount to an error of one or more percent relative to a length of the material web roll is taken into consideration, even higher quality may be achieved; that is, the packaging sheet can be laid against the material web roll more evenly and tightly across its entire width. Tearing of the packaging sheet due to the migration is prevented, because the migration is taken into account during the positioning of the packaging sheet dispenser. Even during production of the end packaging, minor irregularities which could result from the migration can be smoothed over.

It may also be advantageous to provide an axially movable packing press and a folding device for each face. In this manner, the two packing presses and/or the two folding devices can be positioned independently of each other. In conventional processes, the packing presses are be moved together toward an axial center of the packaging device and simultaneously position outer face covers either on the faces of the material web roll or onto the wrapped projection. This arrangement has the advantage that outer axial forces on the material web roll counterbalance each other. However, because the material web roll moves out of the axial center or out of any axial position during helical wrapping, e.g., via migration, one packing press generally meets the material web roll earlier than the other. Consequently, the packing press first meeting the material web roll will push the material web roll toward the other packing press with its speed, thereby causing the other packing press to collide with the material web roll at twice its velocity. Collisions of this magnitude can certainly lead to a tearing of the packaging. Further, the prior art processes cause substantial wear and tear on the packing press motor, while the packing press motor must move the entire weight of the material web roll. The same disadvantages are basically true for the folding device. That is, substantial wear and tear can occur. However, if, as provided in the present invention, the motors are separately controlled from one another, the packing presses as well as the folding devices can be moved to each face of the material web roll independently of one another. This independent movement would result in a packaging that protects the motors, the material web roll, and the packaging. Further, the quality of the packaging may be substantially improved.

The present invention avoids the above-noted disadvantages of the prior art by substantially continuously determining an axial position of the material web roll during the wrapping process, and controlling the axial advance of the packaging sheet dispenser relative to the determined axial position of the material web roll.

Another advantage of the present invention is that the packaging sheet can be better placed against the circumference of the material web roll because the axial movement occurring during the helical packaging of the material web roll is compensated for. Further, the packaging sheet may be moved correspondingly faster or slower parallel to the axial direction of the material web roll so that for any momentary (or instantaneous) position of the roll, the full surface of the packaging sheet is placed against the circumference of the material web roll. It is noted that, if the packaging sheet dispenser were to run ahead, i.e., not account for the migration of the material web roll, then a front edge of the packaging sheet would not be in contact with the same degree of tension as a rear edge of the packing sheet with the material web roll. Thus, under certain circumstances, the front edge of the packaging sheet may be loosened. A corresponding problem with the rear edge of the packaging sheet occurs, albeit in reverse, if the packaging sheet dispenser lags behind the position of the material web roll during wrapping. However, if, in accordance with the present invention, the position of the material web roll is substantially continuously determined, the packaging sheet dispenser can be controlled to compensate for the axial migration of the material web roll. The substantially continuous determination of the position may occur either continuously or at short intervals. However, the interval between individual measurements should be set so that the information gathered by each measurement can be used for accurately adjusting the axial advance of the packaging sheet dispenser.

The axial length of the material web roll may be preferably determined before the wrapping process begins. In accordance with the present invention, the axial positions of both faces of the material web roll may be determined even though only a single positioning sensor is necessarily required. In this manner, not only is an additional sensor saved, but the system does not require the additional operational devices to evaluate a signal from the second sensor.

The present invention is directed to a device for packaging a material web roll, having a longitudinal axis, with a packaging sheet. The device may include a carrier positioned to carry the material web roll, a packaging sheet dispenser positioned to be movable parallel to the longitudinal axis and to dispense the packaging sheet onto at least a portion of a longitudinal extend of the material web roll to form an acute angle between a dispensing direction of the packaging sheet and the longitudinal axis, and a positioning sensor positionable to determine an axial position of the material web roll on the carrier.

In accordance with another feature of the present invention, the positioning sensor may be composed of a distance sensor that cooperates with an end face side of the material web roll. The positioning sensor may be further composed of an ultrasound-distance meter.

In accordance with another feature of the present invention, the device may further include a location detector that determines an axial position of the positioning sensor.

In accordance with a further feature of the present invention, the device may include a folding device that wraps an axial projection of the packaging sheet on a respective end face of the material web roll and a movable carrier carrying the folding device and coupled to the positioning sensor. Further, the folding device may include a rotatable folding wheel, and the device may also include an assisting carrier axially projecting over the rotatable folding wheel to carry the positioning sensor.

In accordance with still another feature of the present invention, the positioning sensor may substantially continuously determine the axial position of the material web roll on the carrier. Further, the positioning sensor may continuously determining the axial position of the material web roll on the carrier at least during one rotation of the material web roll. The device may also include a control device that controls an axial position of the packaging sheet dispenser and the positioning sensor may be coupled with the control device.

In accordance with a still further feature of the present invention, the device may include a packing press and a folding device associated with each end face. The packing presses and folding devices may be positioned for movement parallel to the longitudinal axis and at least one of the packing presses and the folding devices may be independently positionable.

The present invention may be directed to a method for packaging a material web roll with a packaging sheet helically wrapped around the material web roll. The method may include substantially continuously determining an axial position of the material web roll during the helical wrapping and controlling an axial advance of a packaging sheet dispenser in accordance with a momentary determined axial position of the material web roll.

In accordance with a further feature of the present invention, the method may include determining an axial length of the material web roll prior to wrapping.

In accordance with another feature of the present invention, the method may include wrapping a first end packaging to project over a first end face of the material web roll in accordance with the determined axial position of the material web roll. Further, the method may also include wrapping a second end packaging to project over a second end face of the material web roll in accordance with the determined axial position of the material web roll. Still further, the method may include folding a portion of the first end packaging onto the first end face and independently folding a portion of the second end packaging onto the second end face.

In accordance with still another feature of the present invention, the method may include independently moving a first and second packing press toward a first and second end face of the material web roll in accordance with the determined axial position of the material web roll. Further, the method may include independently pressing the first and second packing presses against the first and second end faces of the material web roll.

The present invention is also directed to a packaging device for packaging a material web roll. The device may include a roll carrier adapted to receive the material web roll, a packaging sheet dispenser positioned to move parallel to the roll carrier and pivotably mounted to dispense a packaging sheet in a helical path around the material web roll, and a distance sensor located for determining a position of the material web roll on the roll carrier.

In accordance with another feature of the present invention, the packaging device also includes a driving device for moving the packaging sheet dispenser parallel to the roll carrier. Further, the packaging device may include a control device coupled with the distance sensor and the driving device to variably adjust a moving speed of the driving device in accordance with the determined position of the material web roll on the roll carrier.

In accordance with another feature of the present invention, the distance sensor may be positionable to determine an instantaneous position of an end face of the material web roll. Further, the packaging device may include a sensor carrier positioned to move parallel to the roll carrier and coupled with the distance sensor. The sensor carrier may include a positioning signal device that determines a sensing position of the distance sensor along the roll carrier.

In accordance with still another feature of the present invention, the packaging device may include a folding device positioned to move parallel to the roll carrier and adapted to wrap an end face of the material web roll. The packaging device may also include a driving device that moves the folding device and a control device coupled with the distance sensor and the driving device to position the folding device adjacent the end face. Still further, the packaging device may include a second folding device positioned to move parallel to the roll carrier and adapted to wrap an other end face of the material web roll and a second driving device, coupled to the control device, that independently moves the second folding device to a position adjacent the other end face.

In accordance with yet another feature of the present invention, the packaging device may further include a packing press positioned to move parallel to the roll carrier and adapted to press an end face of the material web roll. Further the packaging device may include a driving device that moves the packing press and a control device coupled with the distance sensor and the driving device to position the packing press against the end face. Still further, the packaging press may include a second packing press positioned to move parallel to the roll carrier and adapted to press an other end face of the material web roll and a second driving device, coupled to the control device, that independently moves the second packing press to a position against the other end face. The packing press and the second packing press may be positioned against the end face and the other end face at substantially a same time and the packing press and the second packing press may be driven to exert a pressure against each of the end face and the other end face.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein.

DETAILED DESCRIPTION OF THE PRESENT INVENTION

Figure 1:
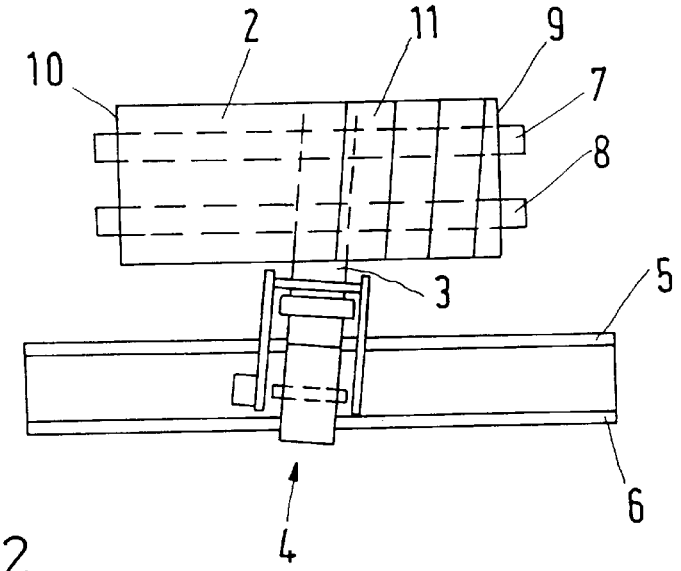
FIGS. 1, 2, and 3 illustrate exemplary process stages in the circumferential packaging of a material web roll.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

Figure 2:
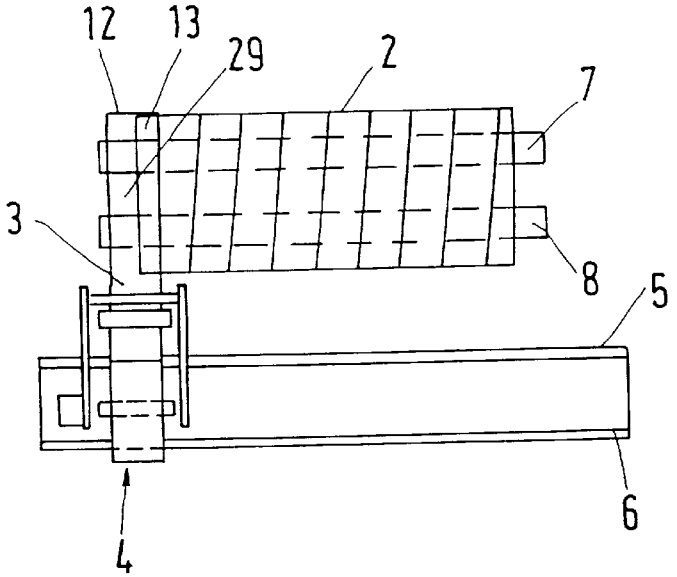
Figure 3:
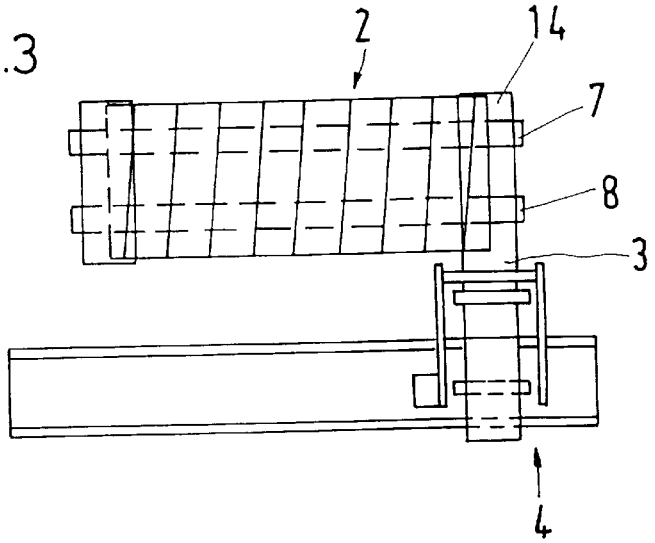

FIGS. 1–3 illustrate a schematic depiction of the packaging of a material web roll 2. In accordance with an exemplary embodiment of the present invention, material web roll 2 may be considered to have an axial length of up to, e.g., approximately 3.8 m or larger. It is noted, however, that a lower limit for material web roll 2 may be, e.g., approximately 0.5 m. A diameter of material web roll 2 may be, e.g., between approximately 0.5 to 2.5 m. Material web roll 2 may be wrapped with a packaging sheet 3, e.g., packing paper, having substantially narrower width than the axial length of material web roll 2, e.g., approximately 0.35 to 0.8 m, and preferably approximately 0.5 m. Packaging sheet 3 may be dispensed, e.g., from a packaging sheet dispenser 4. Packaging sheet dispenser 4 may be moved parallel to a longitudinal axis of material web roll 4 along parallel tracks 5 and 6. Further, packaging sheet dispenser 4 may be pivoted, e.g., from a direction perpendicular to tracks 5 and 6 to a direction that forms an angle, e.g., an acute angle, with a perpendicular line between tracks 5 and 6, as illustrated in FIG. 1. Accordingly, packaging sheet dispenser 4 may dispense packaging sheet 3 to material web roll 2 at an angle with respect to a transverse direction of material web roll 2 that corresponds to the angle formed by the packaging sheet dispenser 4 and perpendicular line between tracks 5 and 6. Material web roll 2 may be placed for rotation upon carrier rolls 7 and 8, at least one of which is motorized for imparting rotation to material web roll 2. Thus, when packaging sheet 3 is dispensed at an angle to the transverse direction of material web roll 2, a helical body packaging 11 results that substantially extends along an entire axial length of the material web roll 2. Further, packaging sheet 3 may well project over end faces 9 and 10 of material web roll 2.

When packaging sheet dispenser 4 has completed body packaging 11, i.e., packaging sheet 3 has been guided along a helical line from one end of material web roll 2 to the other, packaging sheet dispenser 4 may be located on, e.g., the left end of the material web roll 2. Upon completion of the helical wrapping, packaging sheet 3 may be cut or severed to enable preparation of end packaging. As illustrated in FIG. 2, packaging sheet dispenser 4 may be realigned, e.g., perpendicular to tracks 5 and 6, to dispense packaging sheet 3 parallel to the transverse direction of material web roll 2. Packaging sheet 3 may then be wrapped around material web roll 2 to create an axial projection 12 that extends beyond end face 10 of material web roll 2. Axial projection 12 may be utilized to create an end packaging 13. After producing end packaging 13, packaging sheet 3 may again be severed so that packaging sheet dispenser 4 may move to the opposite axial end of the material web roll 2, e.g., the right end, to produce an end packaging 14 that extends beyond end face 9, as shown in FIG. 3.

As discussed above, during the production of body packaging 11, material web roll 2 may axially migrate in a direction of the larger diameter, e.g., to the right in exemplary illustration of FIG. 1. The migration of the material web roll may be estimated at, e.g., approximately 1 to 2 cm per meter length of the material web roll.

The migration of material web roll 2 is accompanied with several problems. For example, the velocity of advance of packaging sheet dispenser 4, which is moved parallel to the longitudinal axis of material web roll 2, may depend only on a helix angle of packaging sheet 3, a circumference of material web roll 2, and a rotational speed of material web roll 2 on carrier rolls 7 and 8, assuming the material web roll remains axially at its position, i.e., without migration. However, if material web roll 2 axially moves, e.g., to the right in FIG. 1, coordination between packaging roll dispenser 4 and material web roll 2 is no longer accurate. Thus, without correction to the movement of packing roll dispenser 4, packaging sheet 3 will no longer be smoothly placed on the circumference of material web roll 2.

At the end of body packaging 11, packaging sheet 3 should exhibit a clear and well-defined projection over end face 10 of material web roll 2. If material web roll 2 moves or migrates, the location of the projection will change, which is undesirable. Further, end packaging 13 and 14 should also be wrapped around the ends of material web roll 2 in the manner discussed above with respect to FIGS. 2 and 3 so that predetermined axial projections are created. If no additional measures are taken, i.e., to compensate for migration, axial projection 12 of end packaging 13 would be too large and the axial projection of end packaging 14 would be too small.

Figure 4:
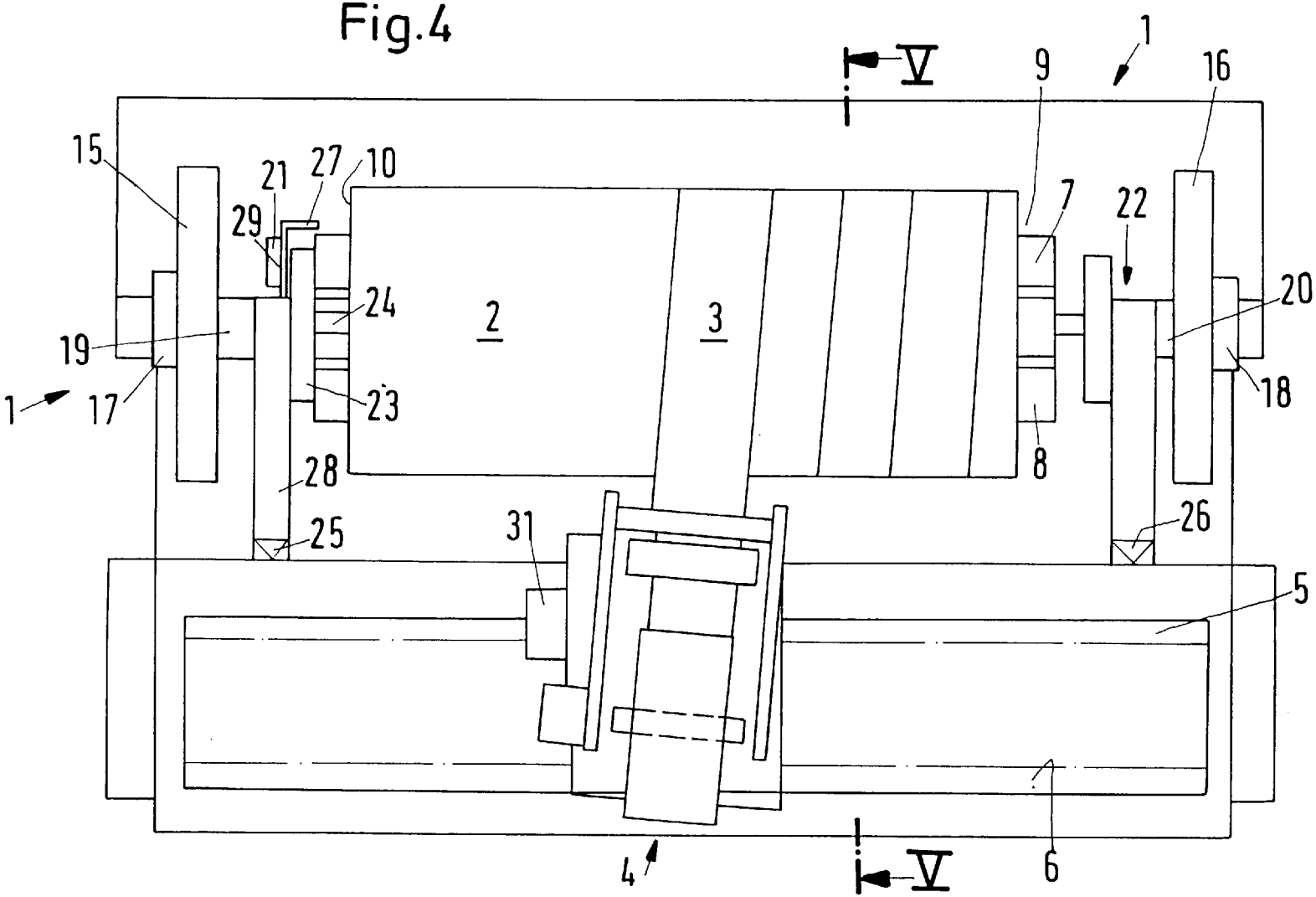
FIG. 4 illustrates a packaging device in accordance with the features of the present invention.

In order to avoid the above-noted problem, a positioning sensor 27, e.g., an ultrasound-distance meter, may be provided. A specific location and exemplary functioning of positioning sensor 27 will be discussed in connection with FIGS. 4 and 5, which show packaging device 1 in greater detail.

For each end face 9 and 10 of material web roll 2, packing presses 15 and 16 may be located on opposite ends of material web roll 2 and substantially parallel to end faces 10 and 9, respectively. Each packing press 15 and 16 includes a respective motor 17 and 18 to independently move the packing presses 15 and 16 in a direction parallel to the longitudinal axis of material web roll 2 along a respective track 19 and 20. Motors 17 and 18 may be, e.g., a cylinder/piston arrangement positioned between packing press 15 or 16 and a frame (not shown) of packaging device 1. As noted above, motors 17 and 18 operate independently of each other.

Further, folding devices 21 and 22 may be provided for each end face 10 and 9, respectively. Each folding device 21 and 22 can be moved parallel to the longitudinal axis of material web roll 2. Folding devices 21 and 22 may be formed, e.g., in a known fashion with an impeller (rotatable folding) wheel 23 and an axis extension 24. Axis extension 24 may be placed onto circumferential surface of material web roll 2 to rotate impeller wheel 23 via the rotating circumferential surface of material web roll 2. In this manner, axial projection 12 of end packaging 13 may be wrapped onto end face 10. In a similar manner, the axial projection of end packaging 14 is wrapped onto end face 9.

However, in accordance with the present invention, positioning signal devices 25 and 26 may be associated with or provided for respective folding devices 21 and 22. In this manner, positioning signal devices 25 and 26 may be utilized to determine an axial location of each of the folding devices 21 and 22.

Figure 5:
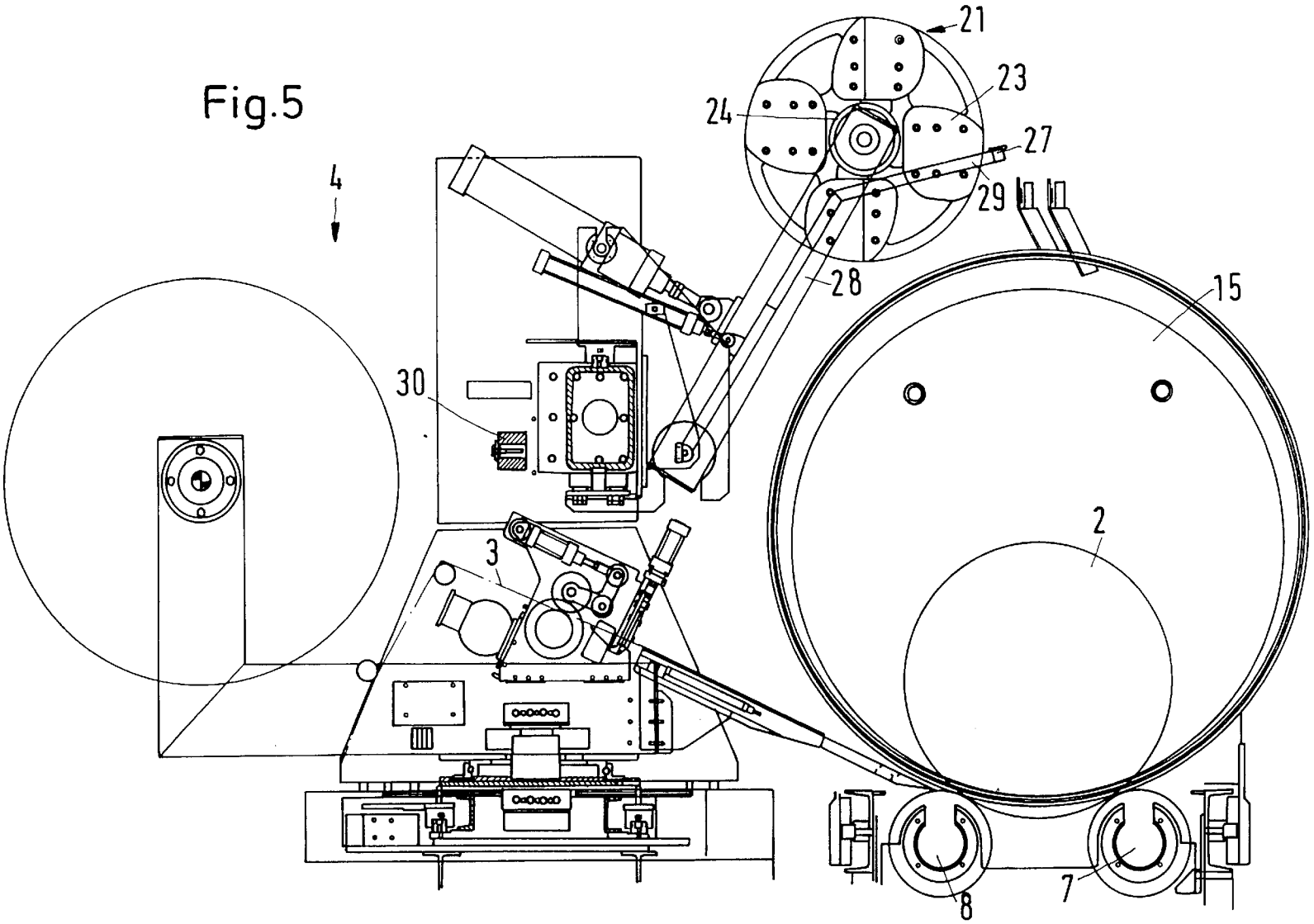
FIG. 5 illustrates a sectional view of the packaging device of the present invention taken along line V—V of FIG. 4.

Additionally, positioning sensor 27 may also be located on folding device 21. For example, folding device 21 may include a carrier 28 to pivotably move folding device 21, e.g., downward as shown in FIG. 5, so as to place axis extension 24 on the circumferential surface of material web roll 2. For the purpose of clarity, the contact position of axis extension 24 against the circumferential surface of material web roll 2 is not illustrated.

An assisting (supplementary) carrier 29 may be coupled to carrier 28 and utilized to carry positioning sensor 27. Assisting carrier 29 may be arranged to radially project over impeller wheel 23. Thus, when carrier 28 is pivoted to place folding device 21 into the folding position, which the exemplary embodiment shows to be an angle of, e.g., between approximately 45° and 90°, positioning sensor 27 is positioned in front of, and axially spaced from, end face 10 of material web roll 2. From this position, a distance between positioning sensor 27 and end face 10 may be determined, and the position of positioning sensor 27 may be ascertained from the location of position signal device 25. In this manner, the axial position of material web roll 2 may be determined with respect to packaging device 1.

A feeling arm may be utilized to hold down an inner face cover during wrapping of axial projection 12 of the end packaging 13 onto end face 10. Further, the feeling arm may be used, e.g., as assisting carrier 29.

With the assistance of positioning sensor 27, a packaging process may be performed in the following exemplary manner. Material web roll 2, having a predetermined (known) axial length and diameter may be laid on carrier rolls 7 and 8 of packaging device 1. In accordance with the features of the present invention, it is not necessary to ensure that material web roll 2 is centered between packing presses 15 and 16 or specifically centered with respect to any elements. It is only necessary that material web roll 2 be laid into packaging device 1 such that each end face 9 and 10 is accessible to the respective packing presses 16 and 15 and folding devices 22 and 21. This positioning is almost always the result of normal transport of material web roll 2 into packaging device 1.

As soon as material web roll 2 is lying on carrier rolls 7 and 8, folding device 21 may be positioned for pivoting at an axial distance from end face 10. Positioning of folding device 21 an axial distance from end face 10 may be initiated from an outermost position of packaging device 1, e.g., on the far left in FIG. 4. Positioning sensor 27 can then be utilized to determine the distance between end face 10 and the position of positioning sensor 27. If positioning sensor 27 is located close enough to end face 10 to produce an accurate distance measurement, folding device 21 can be axially moved inwardly toward end face 10 until the positioning sensor 27 is located within measuring range.

The axial position of end face 10 may then be determined, e.g., by adding the sensed distance between positioning sensor 27 and end face 10 and the distance indicated by positioning signal device 25 for the location of folding device 21. For example, positioning signal device 25 may include evaluation device which counts the impulses of a pace motor 30 that helps to move the folding device 21 axially. Alternatively, a reference point may be established at the outermost position of packaging device 1 and the distance from the reference point to end face 10 may be determined by the distance that positioning signal device 25 moves from the reference point to the in-range measurement position combined with the measured distance from the positioning sensor 27 to end face 10.

Since the axial length of material web roll 2 is known prior to wrapping, determining the position of end face 10 may also be used to calculate the position of end face 9. Packaging sheet dispenser 4 can be axially moved to its initial position and pivoted to the correct angle. The production of body packaging 11 then begins. In this manner, positioning sensor 27 substantially continuously monitors the axial position of end face 10. A control device 31 may be coupled to positioning sensor 27 and the positioning signal 25 to control the velocity or speed of advance of packaging sheet dispenser 4 along tracks 5 and 6, i.e., parallel to the longitudinal axis of material web roll 2, relative to migration of material web roll 2.

Because the positions of end faces 9 and 10 are either known or determined at the conclusion of packaging material web roll 2 in body packaging 11, end packaging 13 and 14 may be accurately attached to material web roll 2 at the appropriate and correct location.

Folding devices 21 and 22 may then be moved into the necessary (and substantially exact) positions for creating or providing optimal wrapping of the projections of end packaging 13 and 14 on end faces 10 and 9, respectively. This substantially exact positioning of folding devices 21 and 22 is only possible if the axial position of end faces 9 and 10 is known. Since migration has likely moved material web roll 2 off-center, it is necessary for folding devices 21 and 22 to be controlled independently of each another. Thus, it is possible that two folding devices 21 and 22 follow different paths before they are placed against the material web roll 2.

The same may be true of packing presses 15 and 16. After wrapping the projections of end packaging 13 and 14, positioning sensor 27 may not be able to determine the axial position of end faces 9 and 10. In this event, positioning sensor 27 may determine the axial position of the wrapped projection, and packing presses 15 and 16 may be moved to that point. To ensure that the outer face covers are attached with the proper pressure by packing presses 15 and 16, packing presses 15 and 16 may be moved further inward toward material web roll 2 in a pressure-controlled manner. Further, each packing press 15 and 16 may be provided with a pressure or feeling sensor that may emit a signal when the packing press or, to be exact, the press plate rests against the end face side of the material web roll 2 with the required pressure.

In accordance with the packaging device of the present invention, it is possible to achieve relatively high packaging speeds, e.g., approximately 300 m/min, for packaging sheet 3. It is noted that, as packaging speeds increase, migration of material web roll 2 does likewise increases. However, in accordance with the above-noted features of the present invention, this increased migration is compensated, and, therefore, not critical.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A device for packaging a material web roll, having a longitudinal axis, with a packaging sheet comprising:

a carrier positioned to carry the material web roll;

a packaging sheet dispenser positioned to be movable parallel to the longitudinal axis and to dispense the packaging sheet onto at least a portion of a longitudinal extent of the material web roll to form an acute angle between a dispensing direction of the packaging sheet and the longitudinal axis; and a positioning sensor positionable to determine an axial position of the material web roll on the carrier during helical wrapping of the material web roll and to control the movement of the packaging dispenser parallel to the longitudinal axis in accordance with the axial position of the material web roll.

2. The device in accordance with claim 1, the positioning sensor being composed of a distance sensor that cooperates with an end face side of the material web roll.

3. The device in accordance with claim 2, the positioning sensor being further composed of an ultrasound-distance meter.

4. The device in accordance with claim 1, further comprising a location detector that determines an axial position of the positioning sensor.

5. The device in accordance with claim 1, further comprising a folding device that wraps an axial projection of the packaging sheet on a respective end face of the material web roll; and a movable carrier carrying the folding device and coupled to the positioning sensor.

6. The device in accordance with claim 5, the folding device comprising a rotatable folding wheel.

7. The device in accordance with claim 6, further comprising an assisting carrier carrying axially projecting over the rotatable folding wheel to carry the positioning sensor.

8. The device in accordance with claim 1, the positioning sensor substantially continuously determining the axial position of the material web roll on the carrier.

9. The device in accordance with claim 8, the positioning sensor continuously determining the axial position of the material web roll on the carrier at least during one rotation of the material web roll.

10. The device in accordance with claim 8, further comprising a control device that controls an axial position of the packaging sheet dispenser; and the positioning sensor being coupled with the control device.

11. The device in accordance with claim 1, further comprising a packing press and a folding device associated with each end face;

the packing presses and folding devices being positioned for movement parallel to the longitudinal axis; and at least one of the packing presses and the folding devices being independently positionable.

12. A method for packaging a material web roll with a packaging sheet helically wrapped around the material web roll comprising:

substantially continuously determining an axial position of the material web roll during the helical wrapping; and controlling an axial advance of a packaging sheet dispenser in accordance with the substantially continuously determined axial position of the material web roll.

13. The method in accordance with claim 12, further comprising determining an axial length of the material web roll prior to wrapping.

14. The method in accordance with claim 12, further comprising:

wrapping a first end packaging to project over a first end face of the material web roll in accordance with the determined axial position of the material web roll.

15. The method in accordance with claim 14, further comprising:

wrapping a second end packaging to project over a second end face of the material web roll in accordance with the determined axial position of the material web roll.

16. The method in accordance with claim 15, further comprising:

folding a portion of the first end packaging onto the first end face; and independently folding a portion of the second end packaging onto the second end face.

17. The method in accordance with claim 12, further comprising:

independently moving a first and second packing press toward a first and second end face of the material web roll in accordance with the determined axial position of the material web roll.

18. The method in accordance with claim 17, further comprising:

independently pressing the first and second packing presses against the first and second end faces of the material web roll.

19. A packaging device for packaging a material web roll comprising:

a roll carrier adapted to receive the material web roll;

a packaging sheet dispenser positioned to move parallel to the roll carrier and pivotably mounted to dispense a packaging sheet in a helical path around the material web roll; and a distance sensor located for determining a position of the material web roll on the roll carrier during helical wrapping of the material web roll and to control the movement of the packaging sheet dispenser parallel to the roll carrier in accordance with the position of the material web roll.

20. The packaging device in accordance with claim 19, further comprising:

a driving device for moving the packaging sheet dispenser parallel to the roll carrier.

21. The packaging device in accordance with claim 20, further comprising:

a control device coupled with the distance sensor and the driving device to variably adjust a moving speed of the driving device in accordance with the determined position of the material web roll on the roll carrier.

22. The packaging device in accordance with claim 19, the distance sensor being positionable to determine an instantaneous position of an end face of the material web roll.

23. The packaging device in accordance with claim 22, further comprising:

a sensor carrier positioned to move parallel to the roll carrier and coupled with the distance sensor.

24. The packaging device in accordance with claim 23, the sensor carrier comprising a positioning signal device that determines a sensing position of the distance sensor along the roll carrier.

25. The packaging device in accordance with claim 19, further comprising a folding device positioned to move parallel to the roll carrier and adapted to wrap an end face of the material web roll.

26. The packaging device in accordance with claim 25, further comprising:

a driving device that moves the folding device; and a control device coupled with the distance sensor and the driving device to position the folding device adjacent the end face.

27. The packaging device in accordance with claim 26, further comprising:

a second folding device positioned to move parallel to the roll carrier and adapted to wrap an other end face of the material web roll; and a second driving device, coupled to the control device, that independently moves the second folding device to a position adjacent the other end face.

28. The packaging device in accordance with claim 19, further comprising a packing press positioned to move parallel to the roll carrier and adapted to press an end face of the material web roll.

29. The packaging device in accordance with claim 28, further comprising:

a driving device that moves the packing press; and a control device coupled with the distance sensor and the driving device to position the packing press against the end face.

30. The packaging device in accordance with claim 29, further comprising:

a second packing press positioned to move parallel to the roll carrier and adapted to press an other end face of the material web roll; and a second driving device, coupled to the control device, that independently moves the second packing press to a position against the other end face.

31. The packaging device in accordance with claim 30, the packing press and the second packing press being positioned against the end face and the other end face at substantially a same time; and the packing press and the second packing press being driven to exert a pressure against each of the end face and the other end face.

32. The device in accordance with claim 1, further comprising a drive coupled to the positioning sensor for providing an axial advance for the packaging sheet dispenser, and adapted to adjust the axial advance of the packaging sheet dispenser in accordance with the determined axial position of the material web roll on the carrier.

33. The device in accordance with claim 32, wherein a rate of advance for the packaging sheet dispenser is a function of the axial position of the material web roll determined by the positioning sensor.

34. The device in accordance with claim 19, further comprising a drive coupled to the distance sensor for providing an axial advance for the packaging sheet dispenser parallel to the roll carrier, and adapted to adjust the axial advance of the packaging sheet dispenser in accordance with the determined axial position of the material web roll on the carrier.

35. The device in accordance with claim 34, wherein a rate of advance for the packaging sheet dispenser is a function of the axial position of the material web roll on the carrier.

* * * * *